US005280174A

United States Patent [19]

Banks et al.

[11] Patent Number: 5,280,174

[45] Date of Patent: Jan. 18, 1994

[54] METHOD AND APPARATUS FOR PRODUCING A THERMAL ATOMIC OXYGEN BEAM

[75] Inventors: Bruce A. Banks, Olmsted Township, Cuyahoga County; Sharon K. Rutledge, Bedford, both of Ohio

[73] Assignee: The United States of America as represented by the Administrator of the National Aeronautics and Space Administration, Washington, D.C.

[21] Appl. No.: 8,026

[22] Filed: Jan. 25, 1993

[51] Int. Cl.[5] ..... H05H 3/00

[52] U.S. Cl. ..... 250/251

[58] Field of Search ..... 250/251

[56] References Cited

U.S. PATENT DOCUMENTS

| | | | |
|---|---|---|---|
| 4,209,704 | 6/1980 | Krimmel | 250/423 R |
| 4,434,131 | 2/1984 | Dagenhart et al. | 376/130 |
| 4,649,273 | 3/1987 | Chutjian | 250/251 |
| 4,828,817 | 5/1989 | Outlaw | 250/251 |
| 4,886,964 | 12/1989 | Pritchard et al. | 250/251 |
| 4,914,305 | 4/1990 | Benveniste et al. | 250/492.3 |
| 4,921,327 | 5/1990 | Zito | 350/96.32 |
| 5,126,575 | 6/1992 | White | 250/492.3 |
| 5,146,098 | 9/1992 | Stack | 250/492.2 |

OTHER PUBLICATIONS

Brink et al., Rev. Sci. Instr., vol. 39, No. 8, Aug. 1968, pp. 1171–1172.

*Primary Examiner*—Jack I. Berman

*Attorney, Agent, or Firm*—Gene E. Shook; James A. Mackin; Guy M. Miller

[57] ABSTRACT

Atomic oxygen atoms are routed to a material through a sufficiently tortuous path so that vacuum ultraviolet radiation is obstructed from arriving at the surface of the material. However, the material surface continues to be exposed to the atomic oxygen.

19 Claims, 2 Drawing Sheets

METHOD AND APPARATUS FOR PRODUCING A THERMAL ATOMIC OXYGEN BEAM

ORIGIN OF THE INVENTION

The invention described herein was made by employees of the U.S. Government and may be manufactured and used by or for the Government for governmental purposes without the payment of royalties thereon or therefor.

TECHNICAL FIELD

This invention is concerned with the production of thermal atomic oxygen beams. The invention is particularly directed to a high flux, broad atomic oxygen beam which is to be impinged upon materials during testing.

Conventional methods of producing thermal atomic oxygen beams comprise exposing samples directly to a plasma produced by a microwave power source and oxygen gas. Typically, an electron cyclotron resonant source is used to produce a mixture of atomic oxygen, oxygen ions, and metastable states. Ion beams also have been produced using electron bombardment ion sources, as well as gridless or end hall ion sources.

Prior art devices designed to allow exposure of samples to atomic oxygen also allow sample exposure to vacuum ultraviolet radiation produced by the plasma associated with production of atomic oxygen. Typically, oxygen plasmas produce very intense vacuum ultraviolet radiation at 130 nm as a result of excitation of atomic oxygen. As a result, any atomic oxygen beam system which allows samples to be exposed to intense plasma will have high levels of 130 nm vacuum ultraviolet radiation exposure. Therefore, one could not separately assess the effects of atomic oxygen exposure from vacuum ultraviolet radiation exposure.

Vacuum ultraviolet radiation exposure is known to damage exposed surfaces of many materials causing their optical properties to change in a manner such that the surfaces appear darker as a result of absorbing more radiation. Such surfaces show significant increases in solar absorptance. Therefore, it has not been possible to distinguish effects of atomic oxygen exposure from the vacuum ultraviolet radiation exposure.

Many materials, such as radiator coatings, have demanding solar absorptance requirements. Poor atomic oxygen durability could be inaccurately diagnosed because of simultaneous vacuum ultraviolet radiation exposure during atomic oxygen testing. The intensity of the 130 nm radiation exceeds that of anticipated in-space levels of radiation by orders of magnitude. Thus, the poor performance of materials exposed to atomic oxygen beams may not at all be indicative of what might be expected under more realistic exposure conditions.

It is, therefore, an object of the present invention to enable a high-flux broad atomic oxygen beam to be impinged upon the surfaces of materials while preventing undesired vacuum ultraviolet radiation from impinging on these surfaces.

Another object of the invention is to enable thermally accommodated atomic oxygen to be impinged upon surfaces while preventing undesirable 130 nm vacuum ultraviolet radiation from damaging these surfaces.

A further object of the invention is to use glass surfaces to scatter atomic oxygen through a tortuous path to arrive at materials being tested.

A still further object of the invention is to use glass surfaces to absorb VUV radiation to prevent it from arriving on the materials being tested.

Still another object of the invention is to use geometric configurations which permit high fluxes of atomic oxygen to arrive on the surfaces of the materials being tested while preventing VUV exposure of these surfaces.

Another object of the invention is to use glass surfaces to eliminate ion and metastable species by their conversion to ground state atomic oxygen.

Still another object of the invention is to use shaped glass surfaces which allow controlled and optional VUV radiation exposure of test surfaces while preventing undesirable radiation exposure from the oxygen plasma source.

Yet another object of the invention is to provide an apparatus which is suitable for broad atomic oxygen beam exposure of samples which is necessary for producing test samples large enough for optical or mechanical evaluation.

BACKGROUND ART

U.S. Pat. No. 4,209,704 relates to a means of separating ions which are being accelerated to a set of targets. The separator is a curved chamber which is used to magnetically steer charged ions. A second deflector redirects the ions and reverses the charge prior to reaching a divider portion used to separate ions by mass.

U.S. Pat. No. 4,434,131 is concerned with an ion recovery system having an electric field diversion component. A flow of particles traverses a chamber, the particles being either charged or neutral. Neutral charges are unaffected by the electric deflection unit while charged particles are recovered along an ion recovery surface. The neutral particles pass through an opening in the wall to escape.

U.S. Pat. No. 4,886,964 describes a means of separating neutral and charged atomic beams using a diffraction grating. A neutral beam diffracts at a different angle than the charged beam under conditions of low incident angles.

U.S. Pat. No. 4,914,305 is directed to an apparatus used for ion implantation of silicon substrate in which a resolving magnet is used to steer an ion source to a set of acceleration units. The resolving magnet redirects charged particles 180° in route to the target material.

U.S. Pat. No. 4,921,327 describes a fiber optic wave carrier which is used to convey an ionizing radiation from a source to a target. The fiber is in the shape of a tube which is capped at one end, thereby preventing the passage of air while allowing the transmission of ions. A collection of small obstructions located at the distal portion of the chamber reflects the ions to produce a wider beam.

U.S. Pat. No. 5,126,575 relates to a broad beam ion implantation device having a redirection unit for steering an ion beam and broadening it to a set of accelerators prior to striking the target.

U.S. Pat. No. 5,146,098 describes an ion beam contamination sensor having a means to establish a baseline spectrum, a means to measure the detected spectrum, a comparison of the detected and baseline spectra, and a means of producing the resultant of these to spectra. If the result is outside the range of acceptable parameters, the implantation process is discontinued.

DISCLOSURE OF THE INVENTION

The aforementioned objects of the invention are achieved by the apparatus of the present invention which is used in the containment of plasma. More specifically, the apparatus facilitates a delivery of atomic oxygen beams to a test piece while preventing the arrival of vacuum ultraviolet radiation associated with the production of atomic oxygen plasmas from exposing the test piece.

An "S" shaped plasma containment vessel directs the plasma flow to a test piece. The walls of the chamber allow UV light to pass while steering the atomic oxygen to the target. Auxiliary UV lamps are used to match the conditions found in earth orbits so that the coating materials are tested under conditions similar to those found in orbit. In this manner, controlled experiments are performed which identify corrosion of materials due to atomic oxygen plasmas independently of ultraviolet degradation.

BRIEF DESCRIPTION OF THE DRAWINGS

The objects, advantages, and novel features of the invention will be more fully apparent from the following detailed description when read in connection with the accompanying drawings wherein.

BEST MODE FOR CARRYING OUT THE INVENTION

Atomic oxygen produced by a microwave or electrical discharge of an oxygen plasma produces a mixture of thermal neutral atoms, oxygen ions, and metastable species. As a result of the de-excitation process, vacuum ultraviolet radiation is produced in the region of the flowing plasma. This radiation, which is most intense at 130 nm, is prevented from impinging upon samples by means of routing the atomic oxygen atoms through a sufficiently tortuous path, such that the vacuum ultraviolet radiation is obstructed from arriving on the samples, yet the atomic oxygen continues to arrive at the sample surfaces.

Figure 1:
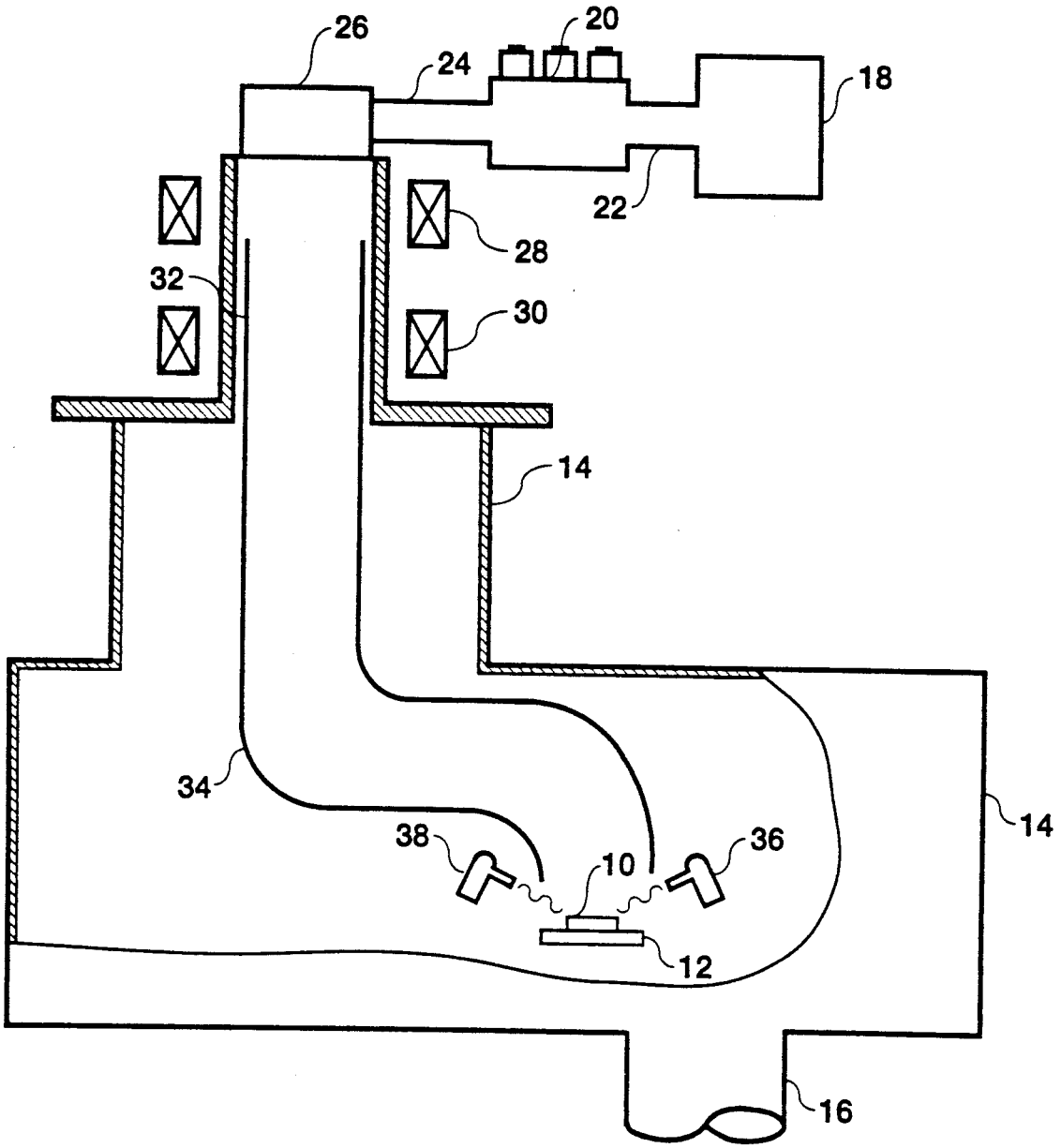
FIG. 1 is a schematic view showing the preferred embodiment of the invention.
Figure 2:
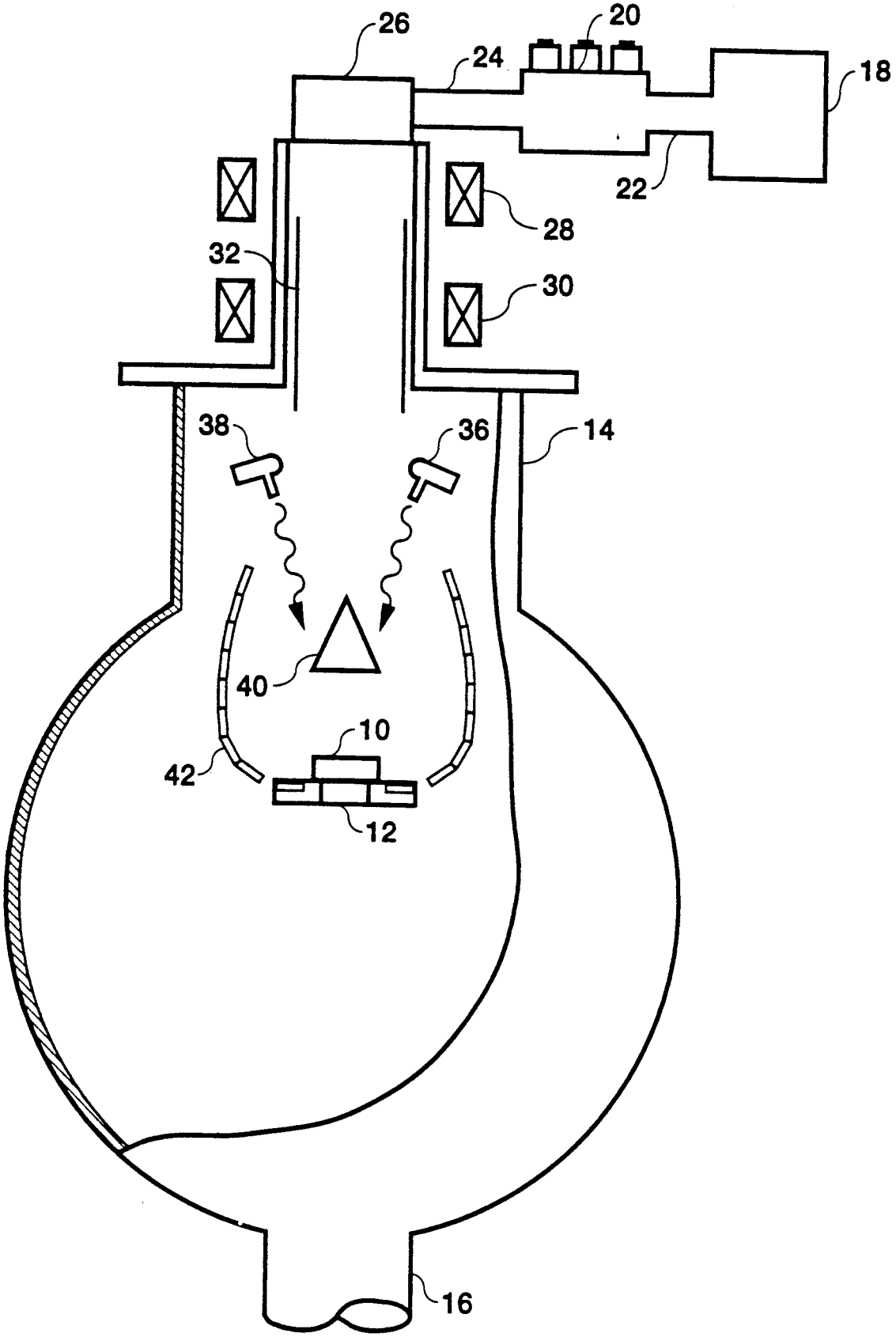
FIG. 2 is a schematic view of an alternate embodiment of the invention.

Referring now to the drawings, there is shown in FIGS. 1 and 2 schematic views of apparatus constructed in accordance with the present invention. A material sample 10 is mounted on a support 12 in a chamber 14. A line 16 connected to a suitable vacuum source such as a pump, not shown, is utilized to evacuate the chamber 14, thereby establishing a vacuum environment for the material 10.

An ECR microwave power system 18 is operably connected to a tuner 20 through a dummy load and circulator 22 for producing atomic oxygen which is supplied to the chamber 14 through waveguides 24 and 26. The atomic oxygen passes through a pair of magnets 28 and 30 to a glass liner 32, as shown in both FIGS. 1 and 2.

According to the preferred embodiment of the present invention a curved glass or fused silica pipe 34 is connected to the glass liner 32 and conveys the atomic oxygen to the material sample 10. An important feature of the invention is that the glass pipe 34 has an "S" shaped configuration. A pair of UV lamps 36 and 38 are positioned adjacent to the material sample 10 at the discharge end of the pipe 34.

As can be seen in FIG. 1, atomic oxygen is ducted to the "S" bend in the glass pipe or duct 34. The glass has minimal reflection for vacuum ultraviolet radiation and high absorptance, resulting in negligible vacuum ultraviolet radiation arriving at the surface of the material sample 10. Because the atomic oxygen is a low energy thermal beam, impingement of ions and metastables on the glass walls will tend to convert these species to thermal energy atoms as well. Thus, the beam of atomic oxygen impinging on the material sample 10 will be largely devoid of ion, metastable, and vacuum ultraviolet radiation content.

DESCRIPTION OF ALTERNATE EMBODIMENT OF THE INVENTION

Referring now to FIG. 2 there is shown an alternate embodiment of the invention wherein the atomic oxygen beam from the glass liner 32 is deflected off a triangular glass prism 40 which obstructs the UV illumination of the material 10 in the holder 12. The triangular glass prism 40 may be fused silica or glass. The triangular glass prism 40 has a sheet of a non ultraviolet radiation transmitting material, such as aluminum foil, placed in the middle of it to prevent longer wavelength ultraviolet radiation that is greater than 200 nm from impinging on the material 10 as well.

Surrounding the triangular glass prism 40 are glass rectangles 42 which scatter the atomic oxygen back onto the material 10. The glass used in the rectangles 42 for deflection or rerouting of atomic oxygen is preferably $SiO_2$. It is contemplated that fluorosilicate, soda lime, or other metal oxide glasses can be used for the glass rectangles 42.

It is apparent from both devices shown in FIGS. 1 and 2 that the intent of the invention is to prevent undesired vacuum ultraviolet radiation from impinging on the material 10. However, it may be desirable to have controlled vacuum ultraviolet or ultraviolet radiation exposure of the material 10. This is facilitated by providing the auxiliary UV lamps 36 and 38 shown in both FIGS. 1 and 2. These lamps are used to provide controlled vacuum ultraviolet exposure of the material 10 while preventing undesirable 130 nm exposure.

While several embodiments of the invention have been shown and described, it will be apparent that the geometry of the glass piping shown in FIG. 1 and the glass enclosure and triangular prism shown in FIG. 2 can be widely varied, depending on the size of the material 10 as well as the geometry of the plasma source region. It is contemplated that various structural modifications may be made to the devices shown in FIGS. 1 and 2 without departing from the spirit of the invention or the scope of the subjoined claims.

What is claimed:

1. Apparatus for exposing material to atomic oxygen comprising a chamber, means for mounting said material in said chamber, means for evacuating said chamber with said material mounted therein for establishing a vacuum environment for said material, means for producing atomic oxygen atoms from oxygen plasma wherein vacuum ultraviolet radiation is produced, means for conveying said atomic oxygen atoms into said chamber, and means for routing said atomic oxygen atoms to said material through a sufficiently tortuous path so that vacuum ultraviolet radiation is obstructed from arriving at said material while atomic oxygen continues to arrive at said material.

2. Apparatus as claimed in claim 1 wherein the means for producing atomic oxygen atoms includes a microwave power system.

3. Apparatus as claimed in claim 2 wherein the vacuum ultraviolet radiation is at 130 nm.

4. Apparatus as claimed in claim 3 including a pipe having a "S" shaped configuration for routing said atomic oxygen atoms to said material.

5. Apparatus as claimed in claim 4 wherein the pipe is glass.

6. Apparatus as claimed in claim 4 where the pipe is fused silica.

7. Apparatus as claimed in claim 3 where the means for routing the oxygen atoms to said material include a triangular prism which obstructs VUV illumination of the material.

8. Apparatus as claimed in claim 7 wherein the triangular prism is of a glass material selected from the group consisting of $SiO_2$ fluorosilicate, soda lime, and other metal oxide glasses.

9. Apparatus as claimed in claim 8 wherein the triangular glass prism contains a sheet of a non ultraviolet radiation transmitting material for inhibiting longer wavelength ultraviolet radiation greater than 200 nm from impinging on the material.

10. Apparatus as claimed in claim 9 wherein the sheet is aluminum foil.

11. A method for exposing material to atomic oxygen comprising mounting said material in a chamber, evacuating said chamber with said material mounted therein thereby establishing a vacuum environment for said material, producing atomic oxygen atoms from oxygen plasma wherein vacuum ultraviolet radiation is produced, conveying said atomic oxygen atoms into said chamber, and routing said atomic oxygen atoms to said material in said chamber through a sufficiently tortuous path so that vacuum ultraviolet radiation is obstructed from arriving at said material while atomic oxygen continues to arrive at said material.

12. A method as claimed in claim 11 wherein the atomic oxygen atoms are produced by microwave power.

13. A method as claimed in claim 12 wherein vacuum ultraviolet radiation at 130 um is produced.

14. A method as claimed in claim 13 including routing said atomic oxygen atoms to said material along an "S" shaped path in said chamber.

15. A method as claimed in claim 14 wherein the path is formed by a glass pipe.

16. A method as claimed in claim 14 wherein the path is formed by a fused silica pipe.

17. A method as claimed in claim 13 wherein the oxygen atoms are routed to said material with a triangular prism and UV illumination of the material is obstructed.

18. A method as claimed in claim 17 wherein the oxygen atoms are routed by a triangular prism of a glass material selected from the group consisting of $SiO_2$, fluorosilicate, soda lime, and other metal oxide.

19. A method as claimed in claim 18 including inhibiting longer wavelength ultraviolet radiation greater than 200 nm from impinging on the material.

* * * * *